United States Patent [19]

Blunden

[11] 3,995,563

[45] Dec. 7, 1976

[54] END DOOR FOR RAIL CARS

[75] Inventor: Donald J. Blunden, Southfield, Mich.

[73] Assignee: Whitehead & Kales Company, River Rouge, Mich.

[22] Filed: May 30, 1975

[21] Appl. No.: 582,229

[52] U.S. Cl. ..... 105/378; 49/40; 49/367; 49/370; 105/368 R; 105/410

[51] Int. Cl.[2] ..... B61D 17/06; B61D 19/00

[58] Field of Search ..... 105/410, 329 R, 353, 105/368 R, 378, 331, 332, 339; 296/147, 148, 155, 55; 49/40, 41, 366, 367, 370; 244/118 R, 129 D, 137 R

[56] References Cited

UNITED STATES PATENTS

| | | | |
|---|---|---|---|
| 785,456 | 3/1905 | Waite | 49/40 |
| 844,585 | 2/1907 | Forsgren | 105/353 |
| 2,164,662 | 7/1939 | Nampa | 105/368 R |
| 3,017,840 | 1/1962 | Fairweather | 105/368 R |
| 3,636,656 | 1/1972 | Dennis | 49/40 |
| 3,718,100 | 2/1973 | Adler et al. | 105/378 |
| 3,854,425 | 12/1974 | Allen | 105/410 X |
| 3,911,831 | 10/1975 | Blunden | 105/368 R X |

FOREIGN PATENTS OR APPLICATIONS

| | | | |
|---|---|---|---|
| 674,374 | 3/1939 | Germany | 49/40 |

*Primary Examiner*—Robert J. Spar
*Assistant Examiner*—Randolph A. Reese
*Attorney, Agent, or Firm*—Whittemore, Hulbert & Belknap

[57] ABSTRACT

An end closure for a rail car which comprises a pair of sliding doors. Locking mechanisms provided for securing the doors in closed position extending across the end of the rail car as well as in open and in intermediate positions. Each door moves from closed to open position through an opening in the side wall of the rail car to an open space on the outer side of the side wall within the allowed rail car clearance.

10 Claims, 14 Drawing Figures

END DOOR FOR RAIL CARS

SUMMARY OF THE INVENTION

The general object of this invention is to provide an end closure for a rail car which will protect the car from illegal or unauthorized entry and which will also protect the contents of the car from flying objects. The end closure comprises one and preferably two sliding doors which can easily and quickly be moved between closed and open positions. When closed, the doors extend across the open end of the rail car. When opened, the doors slide to a stored out-of-the-way position, permitting loading and unloading of the rail car.

In accordance with a preferred embodiment of the invention about to be described, each side wall of the rail car is formed with a vertical opening. When in fully opened position, the door extends through the opening into an open space on the outer side of the side wall but within the allowed rail car side clearance. Accordingly, when the doors are opened for loading and unloading, they do not reduce the loading capacity of the rail car.

Further objects of the invention include the provision of means for securing the doors in the closed as well as the open and intermediate positions, such means being automatically operable, readily accessible and easy to operate. Another object is to provide an end closure which is characterized by safety in transit.

Other objects and advantages of this invention will become apparent as the following description proceeds, especially when considered with references to the accompanying drawings wherein.

Figure 1:
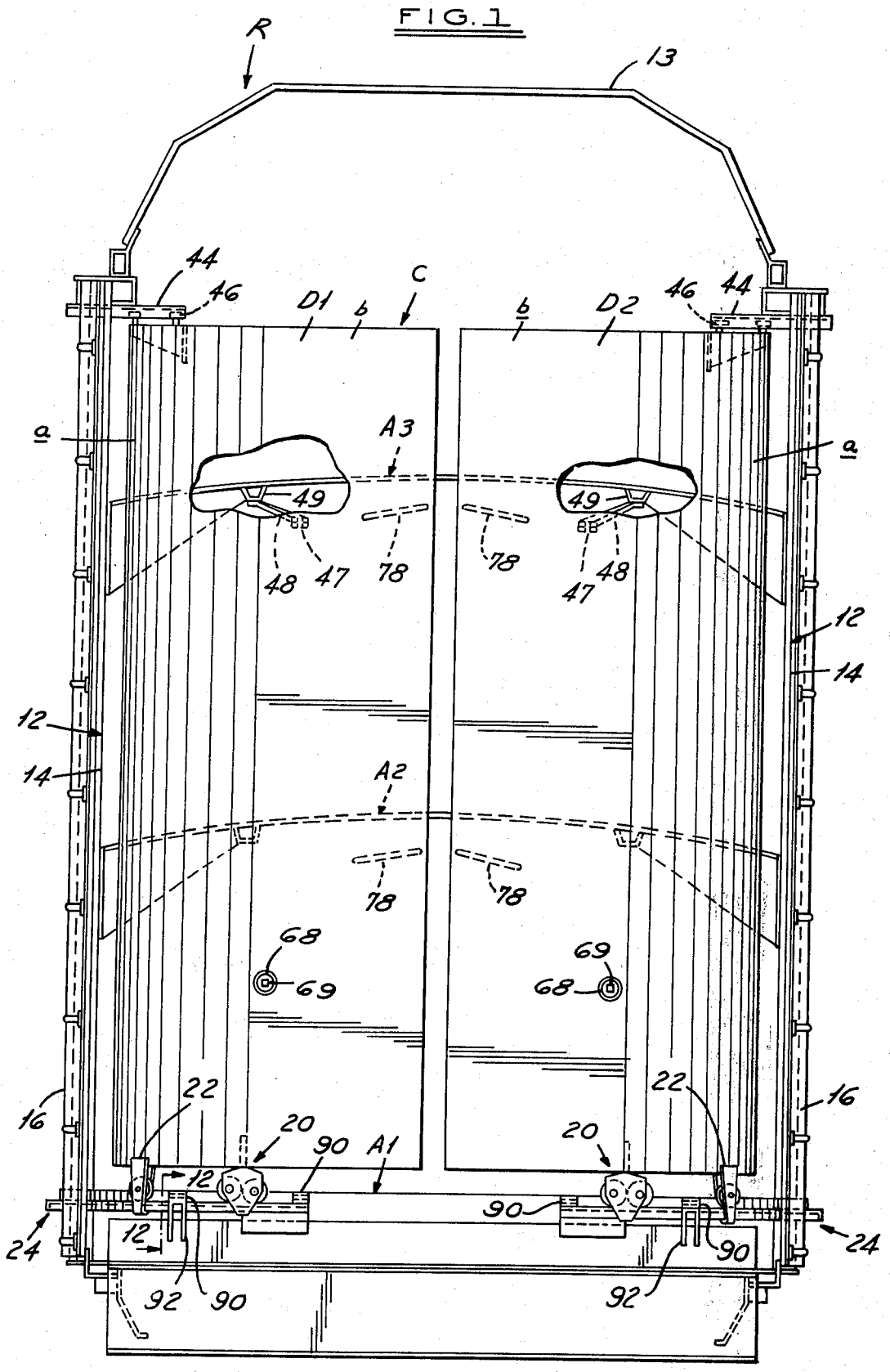
FIG. 1 is an end view of a rail car having an end closure constructed in accordance with the present invention.
Figure 2:
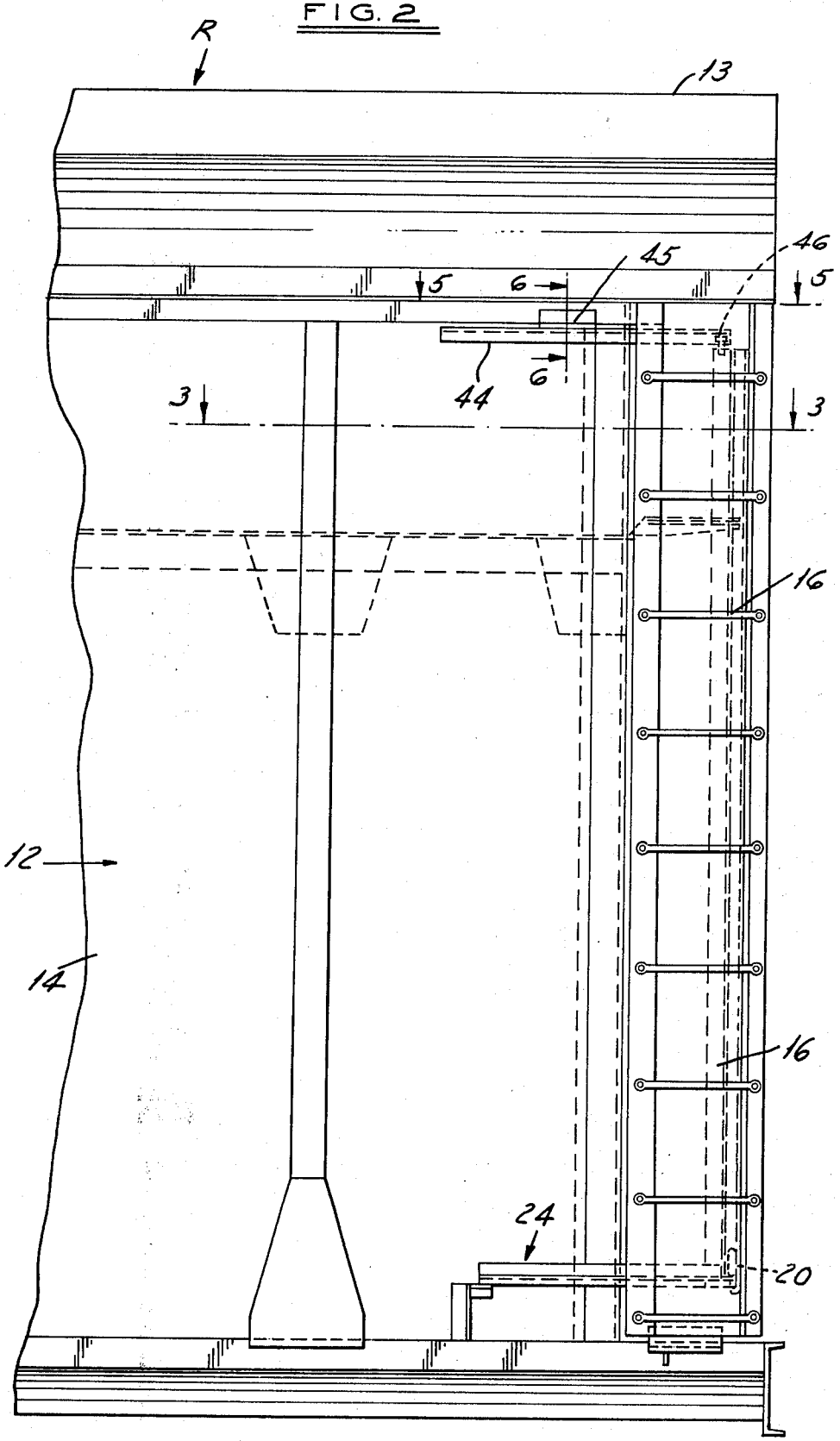
FIG. 2 is a fragmentary side elevational view of the end portion of the rail car shown in FIG. 1.

Referring now more particularly to the drawings, the rail car is generally designated R and is shown as having the elongated longitudinally extending decks A1, A2 and A3 which in this instance are especially adapted for the transport of road vehicles.

The rail car has the side walls 12, and is preferably closed on the top by the roof structure 13 and is open ended. The main portion 14 of each side wall terminates in a vertical edge 5 a short distance from the end of the rail car. Each side wall also has an upright panel 16 positioned beyond the main portion 14 which in this case has rungs spaced apart vertically to enable a workman to climb to the decks A2 and A3 of the rail car. Each panel 16 is spaced laterally outwardly and forwardly of the main portion 14 of the side wall, as will be apparent in FIGS. 3–5, and cooperates with the vertical terminal edge 15 of the main portion in defining a vertically extending slot or gap 19. The slot or gap 19 in each side wall 12 provides an opening for the path of one of the doors of the end closure about to be described.

The end closure structure for one end of the rail car is generally designated C and comprises a pair of doors D1 and D2, each adapted to extend across approximately one-half the end of the rail car so that together the two doors provide substantially a full end closure. The doors D1 and D2 are mirror images of one another so that a description of one will suffice for both. It will be understood that a similar end closure may be provided for the opposite end of the rail car.

Figure 3:
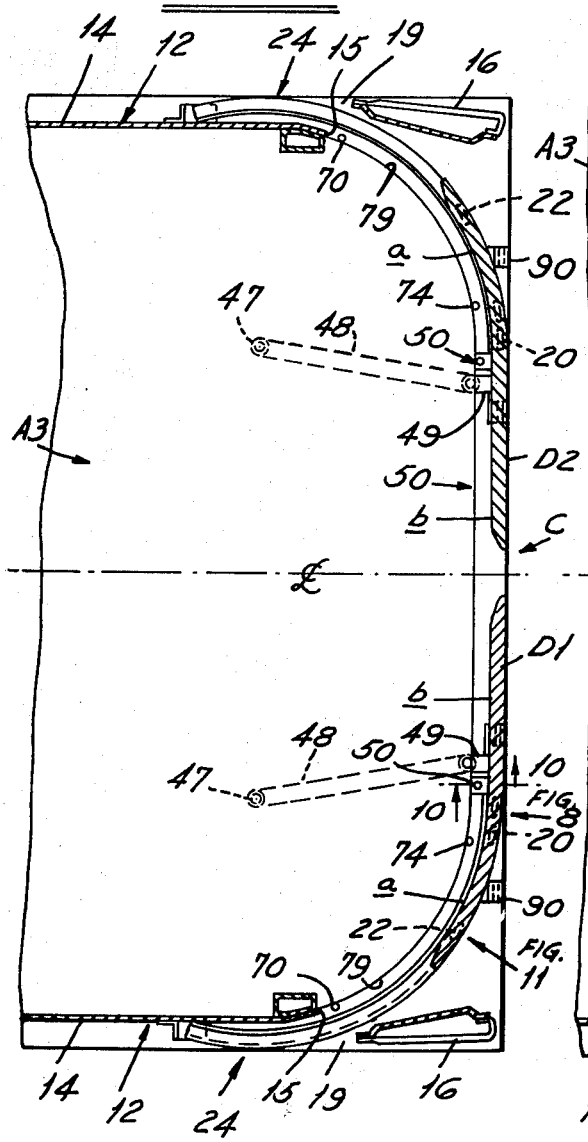
FIG. 3 is a fragmentary sectional view taken on the line 3—3 in FIG. 2, showing the doors in their closed positions.
Figure 4:
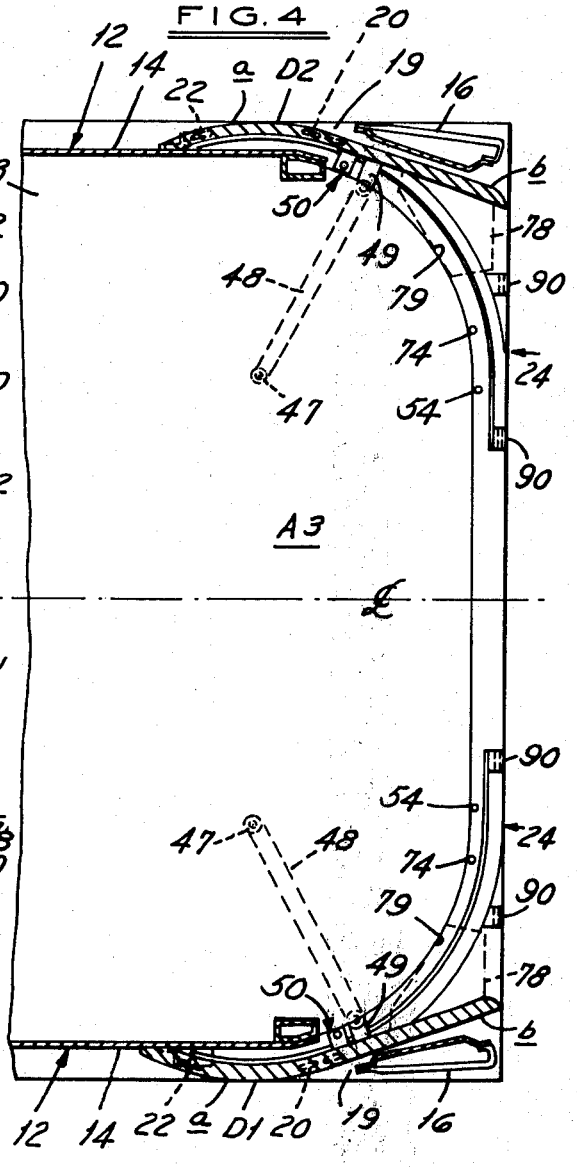
FIG. 4 is similar to FIG. 3 but shows the doors in their open positions.
Figure 5:
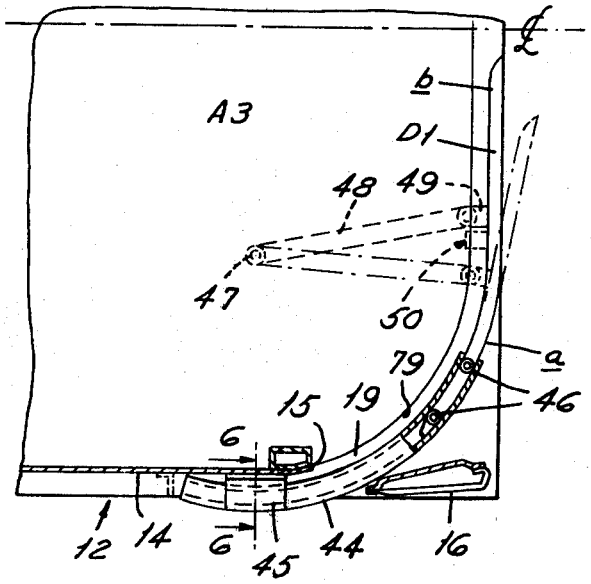
FIG. 5 is a fragmentary sectional view taken on the line 5—5 in FIG. 2.

The door D1 is a vertical panel having the configuration shown in FIGS. 3–5. As there shown, the door D1 has an arcuate laterally outer portion *a* and a straight laterally inner portion *b* which is tangent to the arc of the outer portion *a*. It is supported for sliding movement from the closed position shown in FIGS. 3 and 5 to the open position shown in FIG. 4. When the doors are closed, the straight portions *b* lie in a common plane at right angles to the longitudinal center line of the rail car.

Figure 9:
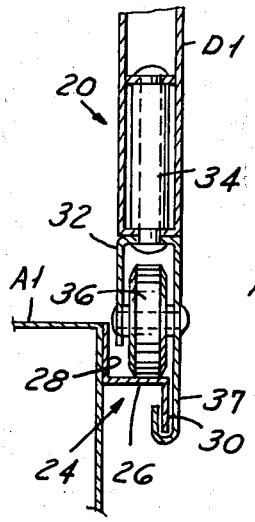
FIG. 9 is a sectional view taken on the line 9—9 in FIG. 8.
Figure 8:
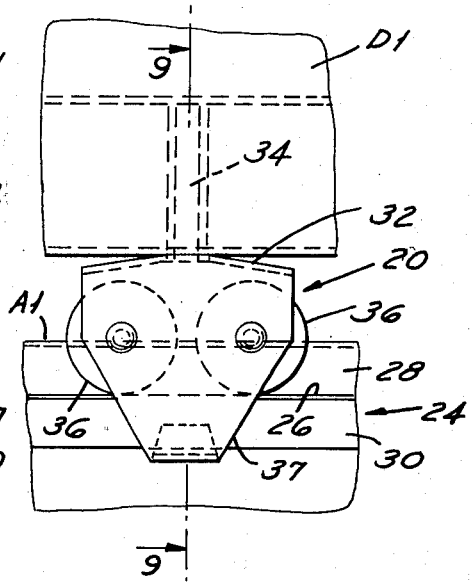
FIG. 8 is a fragmentary detail in elevation showing a roller support assembly for one of the doors.

The lower edge portion of the door D1 is supported by roller assemblies 20 and 22 upon the track structure 24 which may be of the same arcuate form as the portion *a* of the door and terminates in a short straight portion at its inner end. The arcuate portion of the track 24 is in the corner of the rail car and extends through the gap 19 in the side wall 12. The straight portion extends normal to the rail car center line. The track structure 24 is Z-shaped in cross-section as shown in FIG. 9, having the intermediate horizontal track 26 upon which the roller assemblies run and also having the terminal flanges 28 and 30. The flange 28 extends vertically upwardly and is secured to the end of the deck A1 of the rail car, and the vertical flange 30 projects in a downward direction.

The roller assembly 20 in this instance comprises a roller housing 32 of inverted generally U-shape, having a pin 34 extending upwardly therefrom and rotatably supported in the lower edge portion of the door. One or more rollers 36 are journaled on horizontal axes between the flanges of the housing 32 and roll on the horizontal track 26. The roller assembly 20 runs on the curved and straight portions of the track during movement of the door between closed and open positions. One leg of the inverted U-shaped housing 32 has a downward extension 37, the terminal portion of which is bent under the lower edge of the vertical track flange 30 and then upwardly, thereby preventing the door from becoming separated from the track.

The other roller assembly 22 has a roller housing 40 fixed with respect to the lower edge portion of the door which supports a single roller 42 for rotation on a horizontal axis. This roller 42 runs on the curved portion of track 26 during movement of the door between closed and open positions. Housing 40 has a downward extension 43 bent under the track flange 30 and then upwardly to prevent the door from lifting up.

Figure 6:
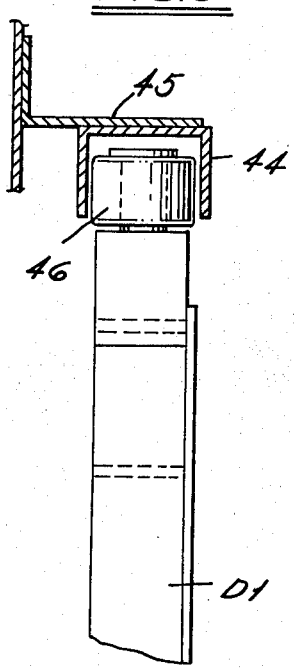
FIG. 6 is a fragmentary sectional detail taken on the line 6—6 in FIG. 2.

The upper edge of the door is guided by a guide 44 which is secured to the rail car above deck A3 by bracket 45 and which may be of the same arcuate form as the portion *a* of the door and as the arcuate portion of track 26. Guide 44 is directly above the arcuate portion of track 26 and, as seen in FIG. 6, is of inverted channel shape. It extends through the gap 19. The upper edge of the door has at least one upwardly projecting roller 46 which turns on a vertical axis and is disposed between and guided by the vertical flanges of the guide 44.

To further support and guide the upper edge portion of the door during its movement between open and closed positions, an arm 48 has one end pivoted at 47 to the underside of the rail car deck A3 and is pivoted at the opposite end to a bracket 49 on the door. Pivot 47 is located at the center of the arc of the curved portion of track 26. The arm 48 in cooperation with the roller 46 stabilizes the upper portion of the door during its opening and closing movement. Obviously, if the curved portion of the track 26 and guide 44 were not arcuate, it would not be practical to employ the arm 48. However, since these curved portions of the track and guide are arcuate, the arm 48 may be used for stabilizing purposes.

Figure 10:
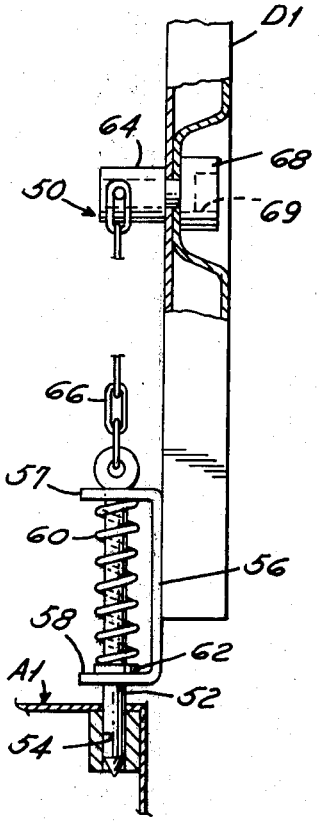
FIG. 10 is a sectional view taken on the line 10—10 in FIG. 3.
Figure 11:
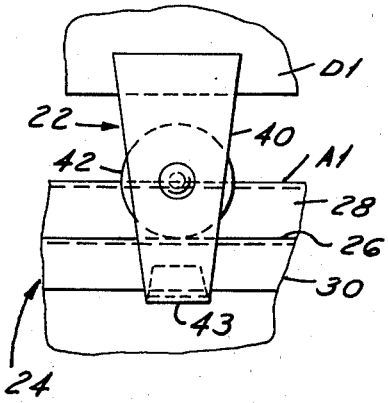
FIG. 11 is a fragmentary elevational view showing another roller support assembly for one of the doors.
Figure 12:
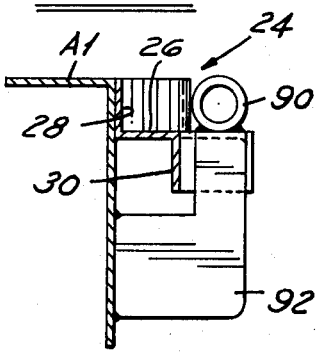
FIG. 12 is a sectional view taken on the line 12—12 in FIG. 1.
Figure 7:
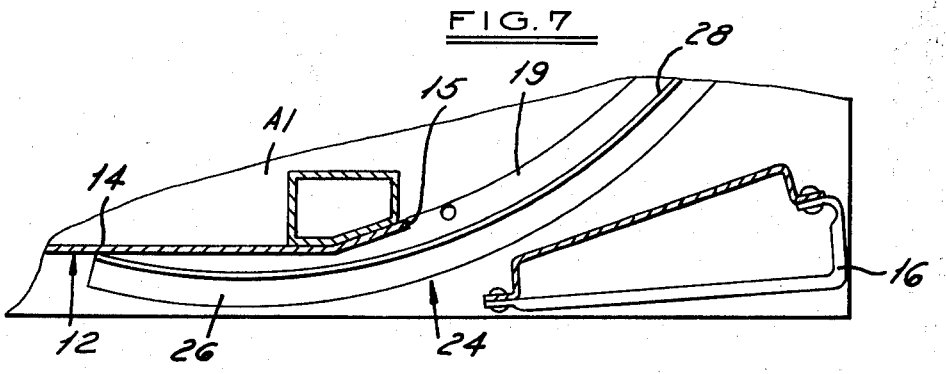
FIG. 7 is an enlarged fragmentary view illustrating a portion of the structure shown in FIG. 3.

The door is provided with a locking mechanism 50 on its inner side for securing the door in closed and open positions and in one or more intermediate positions. The door is shown in FIGS. 3 and 10 locked in its closed position. In this position, the vertical locking pin 52 of the locking mechanism extends downwardly into a hole 54 in the deck A1 to lock the door in its closed position. The pin 52 is supported for vertical movement by the pin holder 56 which is mounted on the door and has a pair of vertically spaced flanges 57, 58. The pin 52 slides in vertically aligned holes in the flanges and is normally urged downwardly to its locked position shown in FIG. 10 by a compression coil spring 60. The spring 60 encircles the pin and bears against the upper flange 57 of the holder and against a collar 62 on the pin to urge the pin downwardly to the lower limit of FIG. 10 in which the collar engages the lower flange 58. The pin 52 may be withdrawn to unlock the door by a shaft 64 and chain 66 secured to and extending between the shaft and the eye on the upper end of the pin. The chain wraps around the shaft 64 when the shaft is rotated to lift the pin. Although the locking mechanism is on the inner side of the door, the shaft is rotatably mounted on the door and has an operating portion 68 projecting through to the outer side of the door which is provided with a non-circular socket 69 in which a tool may be inserted to rotate the shaft.

It will be noted in FIGS. 3 and 4 that the deck A1 of the rail car also has a locking hole 70 for receiving the pin 52 to lock the door when it is in fully opened position. One or more additional deck holes 74 may also be provided for locking the door in intermediate positions between fully open and fully closed positions. Sometimes it is not convenient to lock the door in the fully closed position, depending upon the extent of projection of the load. In such cases it may be sufficient to lock the door in an intermediate position. It will be apparent from a consideration of FIG. 5, which shows the door in an intermediate position in dot-dash lines, that when the door is moved away from fully closed position, its inner straight portion will initially move outward with respect to the rail car, that is, to the right in FIG. 5, providing somewhat more loading space within the car.

The locking holes 54, 70 and 74 are located on an arc traversed by the locking pin 52 during movement of the door between open and closed positions. The pin is pressed downward at all times by spring 60 into contact with the deck A1. The pin therefore will ride on the flat deck surface until it reaches one of the locking holes at which time it will snap automatically into locking engagement. The locking mechanism is therefore automatic in its operation. Having once lifted the pin out of a locking hole by rotation of shaft 64 and initially moved the door, the shaft 64 may be released to allow the pin to travel over the deck until it comes to the next hole where it will automatically lock the door from further movement.

The upper decks A2 and A3 must be recessed at the corners where indicated at 79 to clear the doors D1 and D2 in the closed positions thereof. To substantially close or cover these recesses when the doors are open for purposes of safety, closure members in the form of horizontal plates 78 shown in dotted lines in FIGS. 1 and 4 may be secured to the inner surfaces of the doors just below the level of the decks A2 and A3.

When the doors are moved from closed to open position, they move through the gaps 19 in the side walls 12 and in their fully opened positions the portion of the doors projecting through the gaps will be stored in open spaces on the outer sides of the side walls and do not materially limit or reduce the available space within the rail car for loading. On the other hand, the paths of the track are set in close to the side walls so as to maintain the opened doors within the allowed rail car clearance space.

Figure 13:
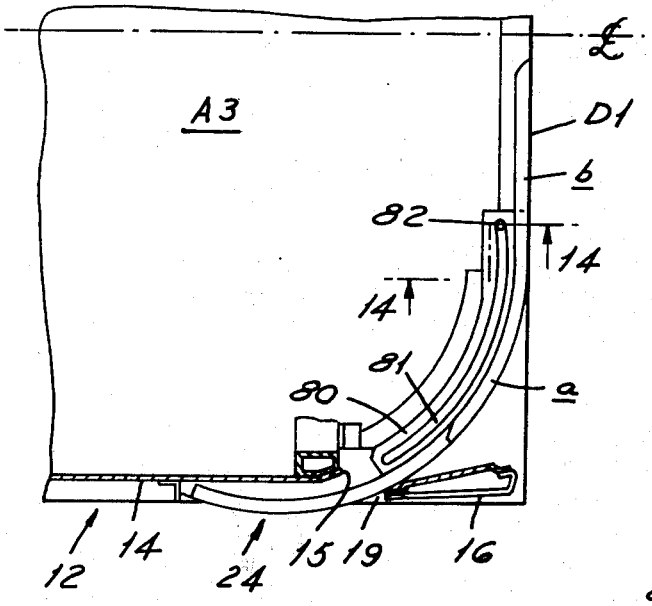
FIG. 13 is a view similar to FIG. 5, but shows a modification.
Figure 14:
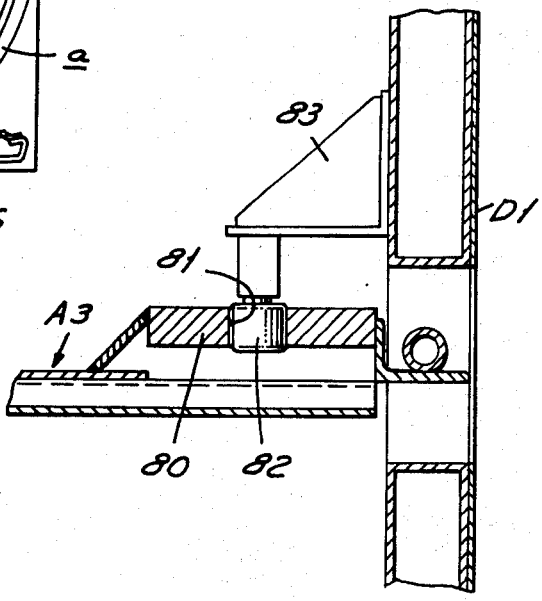
FIG. 14 is a sectional view taken on the line 14—14 in FIG. 13.

A modification of the invention is shown in FIGS. 13 and 14 in which a track 80 is employed in place of the arm 48. This track 80 is mounted on the deck A3 and consists of a curved bar formed with an elongated curved slot 81 for receiving a roller 82 carried by bracket 83 mounted on the door. The roller turns on a vertical axis and is guided between the sides of the slot. The guide structure shown in FIGS. 13 and 14 might be used in place of the arm 48, at least in those instances when the path of the door is not truly arcuate but of some other curved shape.

When loading a rail car, vehicles are often transferred from one car to another and for this purpose a bridge plate is normally required. The horizontal track 26 will also serve as a support for such a bridge plate at the lower deck A1, and for the purpose of securing the bridge to the end of the rail car at the level of the deck A1, sockets 90 are provided so that the bridge may be pinned in proper position. As shown in FIGS. 1, 3, 4 and 12, one of these sockets may be mounted on the horizontal track 26 in a position beyond the point where the roller assemblies 20, 22 travel, and the other socket is mounted on a bracket 92 rigidly mounted on the end of the rail car beneath the track.

The doors D1 and D2 may in the present instance be of a rigid construction, because the curves of the track 26 and guide 44 have a constant radius, that is, they are arcuate. The doors D1 and D2 may of course be flexible or articulated.

What I claim as my invention is:

1. An end closure for a rail car having a side wall, means defining a vertical slot in said side wall near one end of said rail car, said end closure comprising an upright door, said door having a curved laterally outer portion and a planar laterally inner portion, means for guiding said door for lateral movement from a closed position across the end of said rail car to an open position projecting through said vertical slot in which at least a portion of the door is disposed at the outer side of and close to said side wall, said side wall and the adjacent side edge portion of said door in the closed position thereof cooperating to block entry into the rail car, and means for securing said door in its open and closed positions.

2. The end closure set forth in claim 1, wherein said rail car has an open space on the outer side of said side wall adjacent said one end of said rail car into which said portion of the door projects in the open position of said door, said portion of said door when projecting into said open space being disposed within the allowed rail car side clearance.

3. The end closure set forth in claim 1, wherein said means for guiding said door comprises complementary roller and track means.

4. The end closure set forth in claim 3, wherein said track means includes a track having an arcuate portion extending through said slot.

5. The end closure set forth in claim 4, wherein said guide means also includes an arm pivoted to said rail car at the center of curvature of said arcuate portion of said track and connected to said door.

6. The end closure set forth in claim 3, wherein said complementary roller and track means comprises rollers on the bottom of said door and a track mounted on said rail car and on which said rollers travel, said means for guiding said door also including complementary roller and track means for the upper portion of said door.

7. The end closure defined in claim 1, wherein said means for guiding said door comprises a track on said rail car and rollers on said door engageable with said track, and a bridge plate support mounted on said track.

8. An end closure for a rail car comprising a substantially rigid upright door, said door having an arcuate laterally outer portion and a straight laterally inner portion which is tangent to said arcuate portion, means for guiding said door for lateral movement from a closed position across the end of the rail car to an open position adjacent one corner of the rail car, said guiding means including a track having an arcuate section adjacent said corner of the rail car, the radius of curvature of said arcuate section of said track being substantially the same as that of said arcuate portion of said door, and follower means guiding said arcuate portion of said door on said arcuate section of said track so that the inner edge of said door moves longitudinally outwardly in a direction away from the lading during initial movement away from closed position and follows a path outside the path of said track during movement from closed to open position.

9. The end closure defined in claim 8, wherein said arcuate section of said track is located inside said corner of the rail car.

10. The end closure defined in claim 8, wherein the straight portion of said door extends substantially normal to the longitudinal center line of the rail car in the closed position of said door.

* * * * *